US008967385B2

(12) United States Patent
Koslow

(10) Patent No.: US 8,967,385 B2
(45) Date of Patent: Mar. 3, 2015

(54) SEPARATING METHOD AND APPARATUS FOR NON-FERROUS METALS

(71) Applicant: Alexander Koslow, Landshut (DE)

(72) Inventor: Alexander Koslow, Landshut (DE)

( * ) Notice: Subject to any disclaimer, the term of this patent is extended or adjusted under 35 U.S.C. 154(b) by 57 days.

(21) Appl. No.: 13/774,101

(22) Filed: Feb. 22, 2013

(65) Prior Publication Data

US 2013/0161240 A1 Jun. 27, 2013

Related U.S. Application Data

(63) Continuation of application No. PCT/DE2011/001329, filed on Jun. 22, 2011.

(30) Foreign Application Priority Data

Sep. 3, 2010 (DE) ..... 10 2010 036 267

(51) Int. Cl.
*B03C 1/00* (2006.01)
*B03C 1/247* (2006.01)
*B03C 1/18* (2006.01)

(52) U.S. Cl.
CPC . *B03C 1/247* (2013.01); *B03C 1/18* (2013.01); *B03C 2201/20* (2013.01); *B03C 2201/24* (2013.01)
USPC ..... 209/212; 209/214; 209/215; 209/217; 209/222; 209/226

(58) Field of Classification Search
USPC ..... 209/212, 214, 215, 216, 222, 226
See application file for complete search history.

(56) References Cited

U.S. PATENT DOCUMENTS 4,069,145 A * 1/1978 Sommer et al. ..... 209/212
4,106,627 A * 8/1978 Watanabe et al. ..... 209/7
5,108,587 A 4/1992 Walker
5,254,925 A * 10/1993 Flynn ..... 318/696

(Continued)

FOREIGN PATENT DOCUMENTS

DE 4317640 A1 12/1994
DE 19737161 A1 4/1999

(Continued)

OTHER PUBLICATIONS

"Eddy-Current Separator Aids Recycling", Machine Design, Penton Media, Cleveland, OH, US Bd. 63, Nr. 21, Oct. 24, 1991, p. 66, XP000274102, ISSN 0024-91 14.

(Continued)

*Primary Examiner* — Terrell Matthews
(74) *Attorney, Agent, or Firm* — St. Onge Steward Johnston & Reens LLC

(57) ABSTRACT

An installation for clear separation in one cycle of a conglomerate of different metals into individual material components. The installation involves the conglomerate of different metals being comminuted in a machine for producing a homogeneous mixture of metals and being transported to a feeding device. The conglomerate is transported to a highly magnetic rotating drum that separates ferrous-magnetic materials together with fluff and then conveys remaining nonferrous materials to a slowly running conveyor belt, underneath the conveyor belt, slowly rotating discs are mounted in a row that carry on their outer surface area a plurality of permanent magnets of an alternating pol direction. The nonferrous materials include particles that are stripped into a collection bin.

9 Claims, 2 Drawing Sheets

(56) References Cited

U.S. PATENT DOCUMENTS

| | | | | |
|---|---|---|---|---|
| 5,522,513 | A * | 6/1996 | Howell | 209/636 |
| 6,318,558 | B1 * | 11/2001 | Exner | 209/2 |
| 2005/0099081 | A1 * | 5/2005 | Obidniak | 310/156.36 |

FOREIGN PATENT DOCUMENTS

| | | | |
|---|---|---|---|
| DE | 19804878 | A1 | 8/1999 |
| EP | 1364715 | A2 | 11/2003 |
| RU | 2246358 | C1 | 2/2005 |
| WO | 2005042168 | A1 | 5/2005 |
| WO | 2011067402 | A1 | 6/2011 |

OTHER PUBLICATIONS

International Search Report Application No. PCT/DE2011/001329 Completed: Mar. 29, 2012; Mailing Date: Apr. 5, 2012 3 pages.

* cited by examiner

SEPARATING METHOD AND APPARATUS FOR NON-FERROUS METALS

FIELD OF THE INVENTION

An installation and method for separation of a conglomerate of different metals into individual material components.

BACKGROUND OF THE INVENTION

Processes and devices are already known to separate non-ferrous materials in accordance with their individual material components in order reintroduce them into a production line. Processes and devices so far known include a rotating drum, which is equipped with permanent-magnets on its surface. The individual permanent-magnets are arranged on the surface in such a way that on a south pole a north pole follows. These drums rotate at high speed in order to make the separation most efficient. In most cases the conglomerate of different non-ferrous materials is fed to the rotating drums by a conveyor belt. A feeding device transports the conglomerate of non-ferrous materials to the conveyor belt. The rotating magnetic field creates together with the non-ferrous materials an eddy current field, which acts on non-ferrous materials and dependent from the sort of material they slip it away in varying distances. Guiding elements at the exit guide separated material to different containers, each related to a particular metal.

This kind of separation for different non-ferrous materials has the disadvantage that all materials have to pass the same magnetic drum, which rotates at a constant revolution. This leads to an almost constant eddy current field and the slip distance is only dependent from weight and size of the metal piece. For this type of processing random factors play an important role and a clear separation in accordance with the sort of the metals does not exist. Hence, it is necessary to have the material to be separated run several times over the separation device for achieving a sufficient clearness of different non-ferrous materials. Such a procedure is cost intensive, needs time and therefore is inefficient.

SUMMARY OF THE INVENTION

Avoiding such disadvantages is one of the objects of the present invention. Hence, the present invention does not only solve the problem for a clear separation according to the type of metal, but also presents an economic way of separation that leads to a clear separation of a conglomerate of metals to their individual sort of non-ferrous metals in a single run, contrary to that what is possible with the known type of installations.

Objects of the invention are achieved by providing a process and a device that comprises a belt-conveyor on which a conglomerate of non-ferrous metals is fed. Prior to feeding with the conglomerate to be separated it is cleared from even the finest iron dust by having it passed a highly effective magnetic field (high Gauss-figure). This clearing process of the non-ferrous metals from even the finest iron particles by passing a magnetic field has in addition a welcomed side effect that fluff still present is deleted at the same time. Underneath the slowly moving conveyor-belt a plurality of rotating, magnets carrying discs are located, while the magnets are arranged on the discs in an alternating pole relationship. The diameter of these discs is smaller than the width of the conveyor-belt. The discs are arranged in a row in moving direction of the conveyor-belt. Each disc is equipped with its own electrical drive, so the revolution speed and the direction of rotation of each disc can be controlled individually. Hence each disc produces its own eddy current field. This enables to adapt the force of each eddy current field to the needs for separation of each individual non-ferrous metal type. This control may be executed manually or automatically by a control system, which itself is influenced by detectors that investigate the type of non-ferrous material still on the conveyor belt after having passed the eddy current field of a preceding disc. The detectors adjust revolution and direction of rotation of subsequently following discs to a value that meets optimally the requirements for separation of subsequently following non-ferrous materials. Follow-up steps for separation are introduced in advance by an operator only dependent from the material to be sorted. The arrangement of permanent-magnets on the discs has been defined in such way that each north pole is followed by a south pole and vice versa. The permanent-magnets describe with their outer range a bigger diameter that gets smaller in form of a wedge towards the center of the disc. Over the whole area of a disc, the diameter of which is smaller than the width of the conveyor-belt running above it, a plurality of permanent-magnets is arranged, creating when in rotation an eddy current field that has an effect on the non-ferrous materials. That eddy current field, produced in cooperation of the rotating discs and the non-ferrous materials, which depends from the rotation speed of the discs and the kind of non-ferrous material, forces each specific non-ferrous material to the outer range of the conveyor belt. A cast off device or another smaller magnetic disc that possesses its own controllable drive transports the separated non-ferrous material to its specific collection bin. Since each individual disc runs at a revolution that corresponds to the non-ferrous material to be separated it is avoided that discs shed out non-ferrous materials not yet wanted. This is the measure for achieving a clear separation of different non-ferrous materials.

It is useful to reduce the conglomerate to be separated prior to feeding it into a separation device to homogenize it to an equal size by having it passed through a comminuting machine and a machine for producing nodular scrap followed by a screening process. After such a procedure of homogenizing in largeness, the conglomerate should pass over a highly effective magnetic drum (high Gauss-figure) that eliminates besides iron, rough materials as fluffs, finest iron dust, plastic material and other light materials. By doing so it is easy to increase effectiveness and the range of clearness of the followed separation of non-ferrous materials. In order to achieve a homogeneous distribution of material to be separated and in order to further improve efficiency and range of clearness a vibration groove is installed ahead of a high effective magnetic drum. Such a process in advance of starting separation of non-ferrous magnetic materials protects the later followed separation device for non-ferrous materials.

Other objects of the invention are achieved by providing a process for separating non-ferrous materials, the process comprising: providing rotating permanent-magnets, which produce together with non-ferrous materials, to be separated, an eddy current field, the value of the so created eddy field producing varying forces, which depend from the mass of the non-ferrous material to be separated, and hence, eject the different non-ferrous material particles in varying distances, placing the rotating permanent-magnets on rotating discs, the revolution of which can be altered by an electrical drive to adapt the so created eddy current forces to the specific needs for separation of individual non-ferrous materials to be sorted.

In certain embodiments, wherein for separation of a plurality of nonferrous metals contained in a conglomerate of such materials, the number of discs arranged in row in transportation direction underneath of a slowly moving conveyor belt, corresponds to the number of non-ferrous metals, and wherein that the revolution of the individual discs can be controlled in adaptation to the individual separation needs of the non-ferrous metals to be separated.

In certain embodiments, the process further comprises providing detectors mounted above the conveyor belt, the detectors defining the type of non-ferrous metal still contained in a remaining rest of materials, and controlling the revolution of that disc in such a way that according to an earlier fixed plan the desired non-ferrous metal will be cast off.

Other objects of the invention are achieved by providing a device for carrying out the process described above, which comprises a feeding device having a vibration groove on which a conglomerate of nodulized different metallic materials is put and from there transported to high magnetic drum which separates all ferrous magnetic particles contained in that conglomerate into a collection bid, and wherein the remaining non-ferrous materials are transported to a slowly running conveyor belt underneath of which are located, in a row, rotating smaller discs that carry on their outer edge permanent magnets.

In certain embodiments, for expelling the non-ferrous materials separated by one of the discs, a further smaller magnetic disc is located underneath of the conveyor belt downstream of the first disc that transports the material separated by the first disc into the collection bid.

In certain embodiments, the device further includes a cast off installation for expelling non-ferrous material already separated by the first disc from the conveyor belt into the collection bid.

In certain embodiments, wherein underneath the conveyor belt a certain amount of magnetic discs are provided for and arranged in a row, the number of which corresponds to the number of different non-ferrous material particles to be separated and that the revolution speed of these discs can be controlled manually or automatically by detectors.

In certain embodiments, the device further includes detectors that are able to identify the type of non-ferrous material still on the conveyor belt after having passed preceding magnetic discs and that they are able to control revolution speed and direction of the following magnetic discs in a sequence of expelling that was earlier defined by the operators.

Other objects of the invention are achieved by providing a process for separation of non-ferrous metals that operate with rotating permanent magnets that in co-operation with non-ferrous materials create an eddy current field, the repulsing force of which differs due to the mass of the non-ferrous materials to be separated and hence, implies a difference in distance of discharging projection, the process comprising: locating permanent magnets on more than one rotating disc, the amount of which corresponds to the number of different non-ferrous materials to be separated; and arranging the permanent magnets in a row following the moving direction underneath of a slowly running conveyor belt for transport of a conglomerate of stuff, and the revolution of which may be adapted manually or automatically by a controllable electrical drive and by additional means for stripping off separated material into individual bids to guarantee a clear separation of different non-ferrous materials.

Other objects of the invention are achieved by providing a device for execution of the process claimed in claim 9, the device comprising a feeding device that delivers a conglomerate of nodulized, differing metallic stuff via a vibration groove to a rotating, highly magnetic drum where ferrous magnetic particles contained in the conglomerate are eliminated into a container and remaining non-ferrous metallic particles are transported to a slowly running conveyor belt; wherein underneath of the conveyor belt rotating discs that carry magnets producing an eddy current field are located, and wherein the number of discs are equal to the number of different kinds of non-ferrous metals on the conveyor belt and that the revolution of each disc can be adapted in this way that a eddy current field created meets exactly the needs for separation of each individual kind of non-ferrous metal and means are provided at each disc for eliminating a separated kind of non-ferrous metal stuff into separate containers one provided for each kind of non-ferrous metal.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
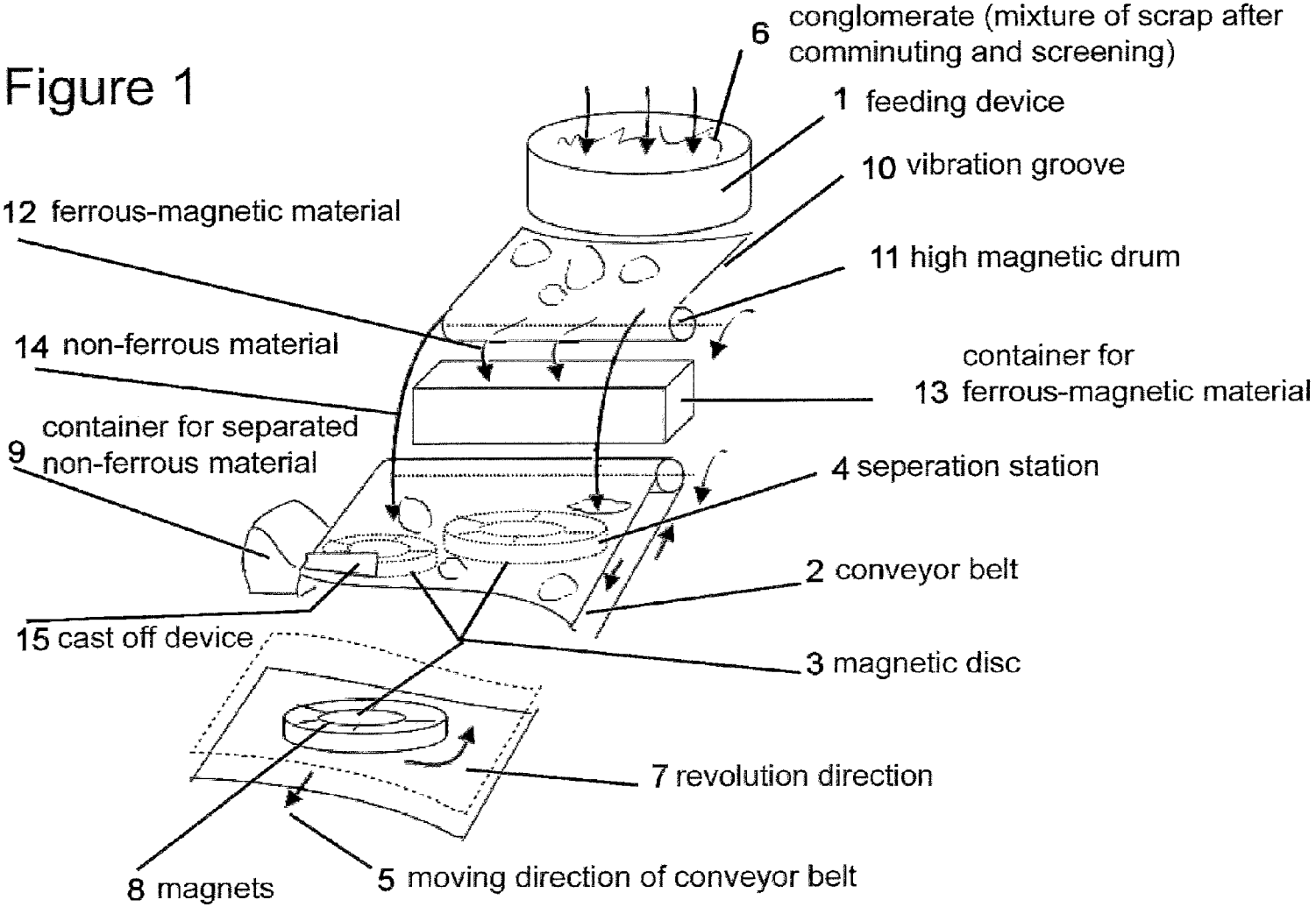
FIG. 1 is a perspective view of a feeding device for a nodular conglomerate of non-ferrous materials.

Referring to FIG. 1, by a feeding device (1) a nodular conglomerate of non-ferrous materials, homogenized to weight and size, is fed on a conveyor-belt (2), once all magnetic materials present in the original conglomerate have been eliminated by a magnetic sorter after having passed the feeding device. A conveyor belt (2) transports the conglomerate (6) of non-ferrous materials along a plurality of separation stations (4), which are arranged in a row showing downstream the moving direction (5) of the conveyor belt (2). These separation stations (4) are represented by a plurality of rotating discs (3) that are arranged in a row showing downstream the direction of transport (5), each of them being equipped with a plurality of permanent-magnets (8). Every disc (3) has its own electrical drive enabling an adjustment of the disc-revolution of each disc (3) to the separation necessity of each individual non-ferrous metal to be sorted out. Rotating discs (3) produce by correlation of their magnets (8) with each individual non-ferrous material an eddy current field the force of which differs from one non-ferrous material to the other. The figure only shows two discs (3) while in reality the number of discs may be bigger and finally only depends from the number of different sorts of non-ferrous materials contained in a conglomerate to be sorted. This procedure enables creation of forces of different strength that react on individual non-ferrous material types and hence, ejecting them into different collection bins (9). The direction of rotation of the discs (3) is indicated by (7). Based on such differing forces initiated, which solely depend on the individual shape, the volume and the weight, and finally the masse of the non-ferrous metal particle and the rotation speed of a related disc (3), a clear separation of individual non-ferrous metals to their specification and type is possible in a single run.

A vibration groove (10) carries out an equal distribution of the conglomerate across the whole width of the conveyor belt (2) and a preceding high magnetic drum (11) eliminates ferrous-magnetic materials (12) and collects them in a container (13). Non-ferrous materials (14) remaining in the conglomerate are transported via the highly magnetic drum (11) to a slowly moving conveyor belt (2) and hence, arrive at individual separation stations (4). A first disc (3) moves a prior defined non-ferrous material towards the edge of the conveyor belt (2). From there a separate smaller magnetic disc or a cast off device (15) transports separated material into a collection bin (9). This process will be continued until all kinds of non-ferrous materials contained in the conglomerate will be separated from one another. For this purpose an adequate number of separation stations (4) are provided. At the very end of the conveyor belt (2) a remaining rest of stainless steel will fall into a container.

Figure 2:
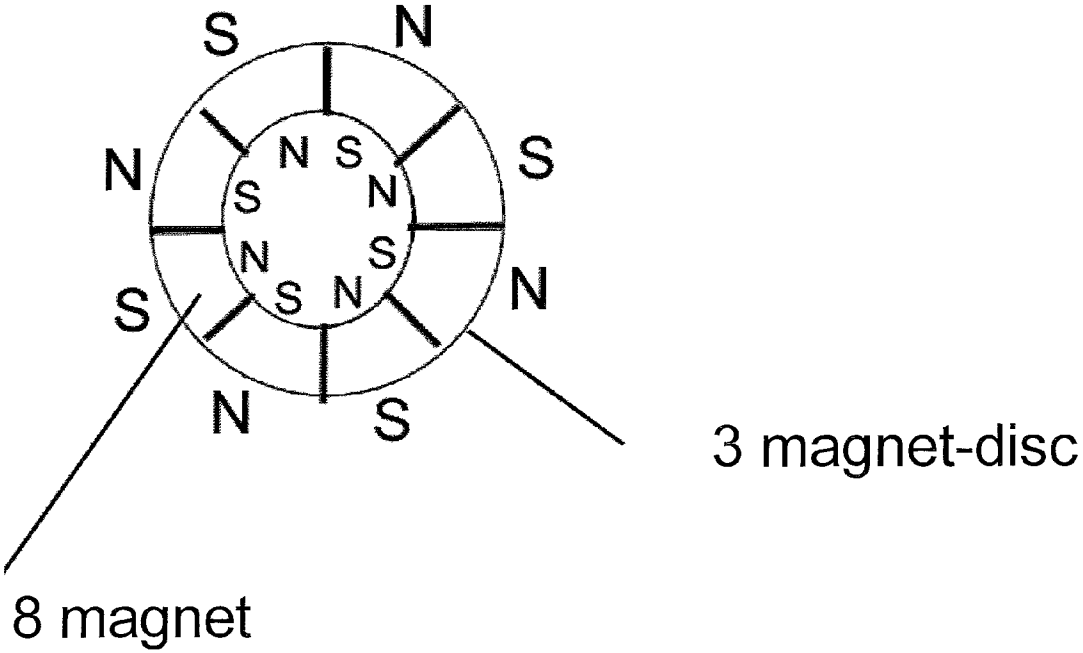
FIG. 2 is a perspective view of a disc with magnets.

Referring to FIG. 2, FIG. 2 shows a disc (3) with magnets (8). The magnets (8) are arranged close to one another along the outer edge of a disc (3) in a kind of configuration that always a magnet (8) of north-pole direction is aside of a magnet (8) of south-pole direction. This configuration defines the total number of magnets (8) placed on a disc (3), since no sequence of equal pole orientation can be allowed. Since the magnets extend from the outer edge of a disc (3) to its center magnets will be shaped in the form of a trapezoid. Fixation of the magnets on the discs (3) will be in an already known manner, however that way that the disc (3) may be able to rotate even at high speed.

While the invention has been specifically described in connection with certain specific embodiments thereof, it is to be understood that this is by way of illustration and not of limitation, and that various changes and modifications in form and details may be made thereto, and the scope of the appended claims should be construed as broadly as the prior art will permit.

The description of the invention is merely exemplary in nature, and, thus, variations that do not depart from the gist of the invention are intended to be within the scope of the invention. Such variations are not to be regarded as a departure from the spirit and scope of the invention.

What is claimed is:

1. A process for separating non-ferrous materials, the process comprising:

providing rotating permanent-magnets, which produce together with non-ferrous materials, to be separated, an eddy current field, the value of the so created eddy field producing varying forces, which depend from the mass of the non-ferrous material to be separated, and hence, eject the different non-ferrous material particles in varying distances, placing the rotating permanent-magnets on rotating discs, the revolution of which can be altered by an electrical drive to adapt the so created eddy current forces to the specific needs for separation of individual non-ferrous materials to be sorted, wherein the number of discs arranged in row in transportation direction underneath of a slowly moving conveyor belt, corresponds to the number of non-ferrous metals, and wherein that the revolution of the individual discs can be controlled in adaptation to the individual separation needs of the non-ferrous metals to be separated.

2. The process of claim 1, further comprising providing detectors mounted above the conveyor belt, the detectors defining the type of non-ferrous metal still contained in a remaining rest of materials, and controlling the revolution of that disc in such a way that according to an earlier fixed plan the desired non-ferrous metal will be cast off.

3. A Device for carrying out the process of claim 1, further comprising a feeding device having a vibration groove on which a conglomerate of nodulized different metallic materials is put and from there transported to high magnetic drum which separates all ferrous magnetic particles contained in that conglomerate into a collection bid, and wherein the remaining non-ferrous materials are transported to a slowly running conveyor belt underneath of which are located, in a row, rotating smaller discs that carry on their outer edge permanent magnets.

4. The device of claim 3, wherein for expelling the non-ferrous materials separated by one of the discs, a further smaller magnetic disc is located underneath of the conveyor belt downstream of the first disc that transports the material separated by the first disc into the collection bid.

5. The device of claim 3 further comprising a cast off installation for expelling non-ferrous material already separated by the first disc from the conveyor belt into the collection bid.

6. The device of claim 3, wherein underneath the conveyor belt a certain amount of magnetic discs are provided for and arranged in a row, the number of which corresponds to the number of different non-ferrous material particles to be separated and that the revolution speed of these discs can be controlled manually or automatically by detectors.

7. The device of claim 3, wherein detectors are provided that are able to identify the type of non-ferrous material still on the conveyor belt after having passed preceding magnetic discs and that they are able to control revolution speed and direction of the following magnetic discs in a sequence of expelling that was earlier defined by the operators.

8. A process for separation of non-ferrous metals that operate with rotating permanent magnets that in co-operation with non-ferrous materials create an eddy current field, the repulsing force of which differs due to the mass of the non-ferrous materials to be separated and hence, implies a difference in distance of discharging projection, the process comprising:

locating permanent magnets on more than one rotating disc, the amount of which corresponds to the number of different non-ferrous materials to be separated; and arranging the permanent magnets in a row following the moving direction underneath of a slowly running conveyor belt for transport of a conglomerate of stuff, and the revolution of which may be adapted manually or automatically by a controllable electrical drive and by additional means for stripping off separated material into individual bids to guarantee a clear separation of different non-ferrous materials.

9. A device for execution of the process claimed in claim 8, the device comprising:

a feeding device that delivers a conglomerate of nodulized, differing metallic stuff via a vibration groove to a rotating, highly magnetic drum where ferrous magnetic particles contained in the conglomerate are eliminated into a container and remaining non-ferrous metallic particles are transported to a slowly running conveyor belt;

wherein underneath of the conveyor belt rotating discs that carry magnets producing an eddy current field are located, wherein the number of discs are equal to the number of different kinds of non-ferrous metals on the conveyor belt and that the revolution of each disc can be adapted in this way that a eddy current field created meets exactly the needs for separation of each individual kind of non-ferrous metal and means are provided at each disc for eliminating a separated kind of non-ferrous metal stuff into separate containers one provided for each kind of non-ferrous metal.

* * * * *